US005592925A

United States Patent [19]

Machida et al.

[11] Patent Number: 5,592,925

[45] Date of Patent: Jan. 14, 1997

[54] EXHAUST GAS RECIRCULATION DEVICE FOR INTERNAL COMBUSTION ENGINE

[75] Inventors: Minoru Machida; Toshio Yamada; Yukihito Ichikawa; Yoshiyuki Kasai, all of Nagoya, Japan

[73] Assignee: NGK Insulators, Ltd., Japan

[21] Appl. No.: 524,253

[22] Filed: Sep. 6, 1995

[30] Foreign Application Priority Data

Sep. 14, 1994 [JP] Japan ..... 6-220057

[51] Int. Cl.[6] ..... F02M 25/07; F01N 3/02

[52] U.S. Cl. ..... 123/568; 123/569; 60/279; 60/311

[58] Field of Search ..... 123/568, 569, 123/570; 60/278, 279, 311

[56] References Cited

U.S. PATENT DOCUMENTS

| | | | |
|---|---|---|---|
| 3,605,710 | 9/1971 | Hewig | 123/570 |
| 4,345,572 | 8/1982 | Suzuki et al. | 123/570 |
| 4,356,806 | 11/1982 | Freesh | 123/570 |
| 4,587,807 | 5/1986 | Suzuki | 60/279 |
| 4,864,821 | 9/1989 | Hoch | 60/279 |
| 5,253,476 | 10/1993 | Levendis et al. | 60/311 |
| 5,373,696 | 12/1994 | Adamczyk, Jr. et al. | 60/311 |
| 5,390,492 | 2/1995 | Levedis | 60/311 |
| 5,426,936 | 6/1995 | Levendis et al. | 60/311 |
| 5,494,020 | 2/1996 | Meng | 123/568 |

FOREIGN PATENT DOCUMENTS

| | | |
|---|---|---|
| 62-255510 | 11/1987 | Japan . |
| 63-104619 | 7/1988 | Japan . |

*Primary Examiner*—Willis R. Wolfe
*Attorney, Agent, or Firm*—Parkhurst, Wendel & Burr, L.L.P.

[57] ABSTRACT

An exhaust gas recirculation device for an internal combustion engine has a filter for trapping particulates in a recirculation gas, which is arranged in a recirculation gas route, and a device for generating a reverse air flow in which a pure gas flow for the reverse air flow passing through said filter in a reverse direction with respect to a recirculation gas flowing direction in the filter is generated. In the exhaust gas circulation device, the trapped gases are discharged out of the filter by the reverse air flow and are not returned into the internal combustion engine due to an engine exhaust pressure.

14 Claims, 3 Drawing Sheets

EXHAUST GAS RECIRCULATION DEVICE FOR INTERNAL COMBUSTION ENGINE

BACKGROUND OF THE INVENTION

1. Field of the Invention

The present invention relates to an exhaust gas recirculation device for an internal combustion engine (hereinafter, sometimes referred to as an EGR device), and especially relates to an EGR device in which a filter for trapping particulates in an exhaust gas is arranged in a recirculation gas route (hereinafter, sometimes referred to as an EGR gas route).

2. Related Art Statement

Usually, in order to decrease an amount of NOx in an exhaust gas, use is made of a method of recirculating the exhaust gas in which a part of the exhaust gas is derived from an exhaust system of an internal combustion engine and is returned to an air intake system thereof. In this method, since particulates included in the exhaust gas are also returned to an engine, an abrasion of engine parts such as a value, a piston and so on, due to the returned particulates is very hard, and thus there exists a problem such that a life of the engine as well as an engine performance is decreased extraordinarily.

In order to eliminate the drawback mentioned above, an abrasion performance is made excellent by improving a material of engine parts, or a filter is arranged in a recirculation gas route. Such a technic is known from for example Japanese Patent Laid-Open Publication No. 62-255510 (JP-A-62-255510). However, the material improvement of engine parts can not eliminate the drawback mentioned above fundamentally. Moreover, when use is made of the filter for trapping the particulates, a pressure loss is increased abruptly since a stuffing of the filter is caused by the particulates in the recirculation gas route. Therefore, there occurs a drawback such that an EGR rate defined by a rate of recirculation of the exhaust gas is largely deviated.

SUMMARY OF THE INVENTION

It is an object of the present invention to eliminate the drawbacks mentioned above and to provide an exhaust gas recirculation device for an internal combustion engine in which an abrupt pressure loss of the filter for trapping particulates in an EGR gas route can be prevented.

According to the invention, an exhaust gas recirculation device for an internal combustion engine comprises a filter for trapping particulates in a recirculation gas, which is arranged in a recirculation gas route, and a device for generating a reverse air flow in which a pure gas flow for said reverse air flow passing through said filter in a reverse direction with respect to a recirculation gas flowing direction in said filter is generated, wherein a filter regeneration is performed in such a manner that the trapped particulates are discharged out of said filter by said reverse air flow and the trapped particulates are not returned to said internal combustion engine.

In the constitution mentioned above, since the filter is arranged in the EGR gas route and the particulates trapped in the filter can be discharged out of the filter by using the reverse air flow generated by the device for generating the reverse air flow, it is possible to prevent an abrupt pressure loss increase of the filter. Moreover, in the case of performing the filter regeneration, the particulates discharged from the filter is not returned into the engine due to an engine exhaust gas pressure and thus the particulates can be discharged into the air through a muffler.

DESCRIPTION OF THE PREFERRED EMBODIMENTS

Figure 1:
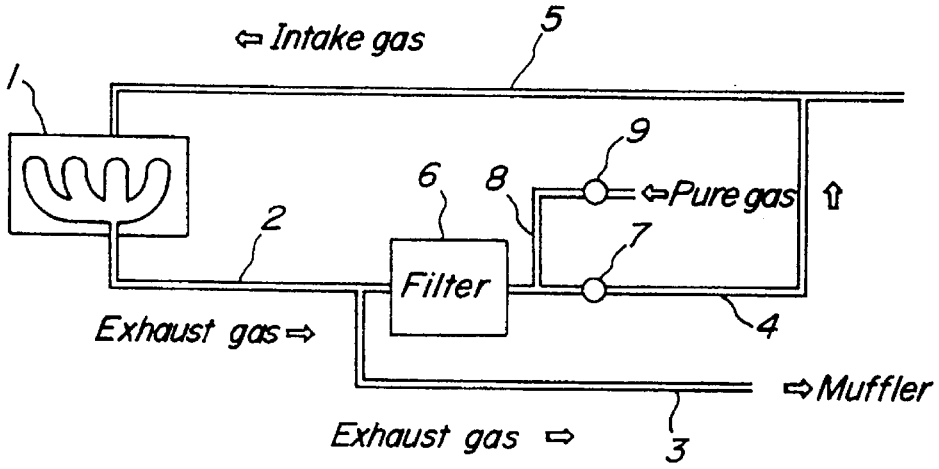
FIG. 1 is a schematic view showing one embodiment of an exhaust gas recirculation device (EGR device) according to the invention.

FIG. 1 is a schematic view showing one embodiment of an exhaust gas recirculation device for an internal combustion engine (EGR device) according to the invention. In the embodiment shown in FIG. 1, a numeral 1 is an engine, numerals 2 and 3 are exhaust gas routes, a numeral 4 is a recirculation gas route (EGR gas route) and a numeral 5 is an intake gas route. Moreover, a numeral 6 is a filter for trapping particulates in a recirculation gas (hereinafter, sometimes referred to as an EGR gas) arranged in the EGR gas route 4, a numeral 7 is an exhaust gas recirculation valve (hereinafter, sometimes referred to as an EGR valve) for adjusting a recirculation gas flow arranged at a downstream position of the filter 6 in the EGR gas route 4, a numeral 8 is a pure gas route through which a pure gas for a reverse air generated by a device for generating a reverse air flow, and a numeral 9 is a reverse air control valve arranged in the pure gas route 8.

In the embodiment shown in FIG. 1, an exhaust gas recirculation operation is performed in such a manner that a part of an exhaust gas discharged from the engine 1 i.e. a recirculation gas is passed through the exhaust gas route 2, the filter 6, the EGR gas route 4 and the intake gas route 5 by controlling the EGR valve 7. Therefore, since the recirculation gas is passed through the filter 6, the particulates in the recirculation gas can be trapped by the filter 6. In this case, the reverse air control valve 9 is closed.

Then, if a pressure loss of the filter 6 due to the trapped particulates becomes a predetermined valve, a filter regeneration operation is performed. In this case, under such a condition that the EGR valve 7 is closed and the reverse air control valve 9 is opened, the pure gas for the reverse air is supplied to the filter 6 through the pure gas route 8, and thus the trapped particulates are discharged to the exhaust gas route 2. However, since an exhaust gas pressure is large, the discharged particulates are not returned to the engine 1 but are discharged to the air through the exhaust gas route 3.

Figure 2:
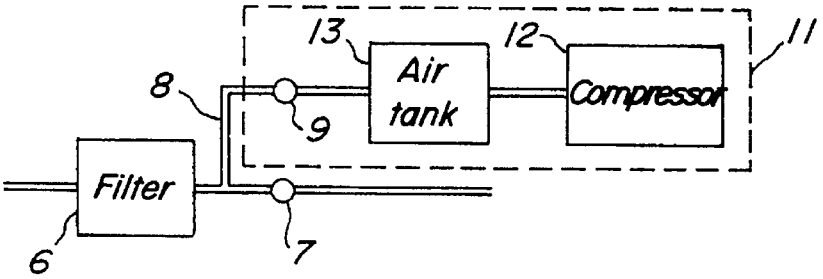
FIG. 2 is a schematic view illustrating one embodiment of a device for generating a reverse air flow used in the EGR device according to the invention.

FIGS. 3 to 6 are schematic views respectively showing another embodiment of the EGR device according to the invention. In FIGS. 3 to 6, portions similar to those of FIG. 1 are denoted by the same reference numerals shown in FIG. 1, and the explanations thereof are omitted. Also in the embodiments shown in FIGS. 3 to 6, the device for generating the reverse air flow 11 shown in FIG. 2 can be preferably applied. Moreover, different points as compared with the embodiment shown in FIG. 1 are as follows.

Figure 3:
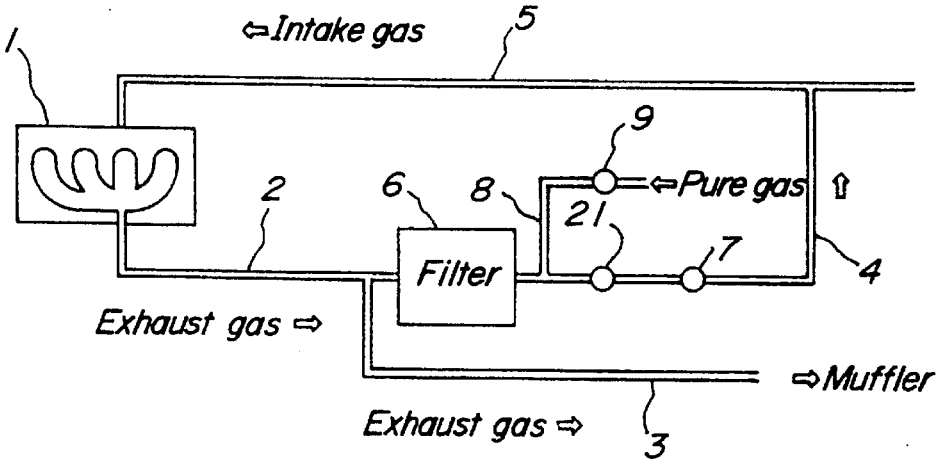
FIG. 3 is a schematic view depicting another embodiment of the EGR device according to the invention.
Figure 4:
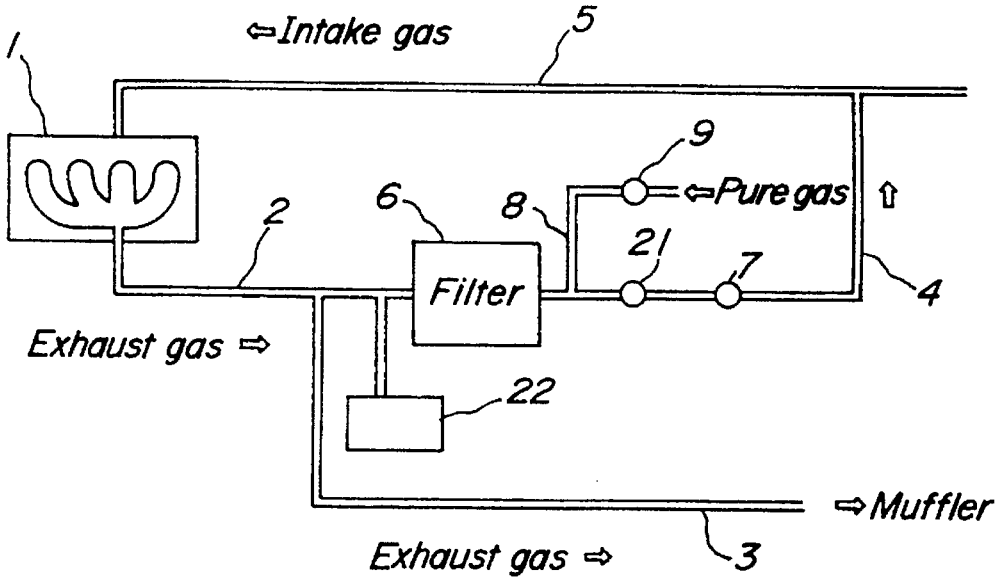
FIG. 4 is a schematic view showing still another embodiment of the EGR device according to the invention.

In the embodiment shown in FIG. 3, an exhaust valve 21 used when the filter regeneration operation is performed is arranged in the EGR gas route 4 at a position from the filter 6 to the EGR valve 7. Therefore, it is easy to perform the filter regeneration operation as compared with the embodiment shown in FIG. 1 in which the EGR valve 7 is used as the exhaust valve. Moreover, in the embodiment shown in FIG. 4, the exhaust valve 21 is arranged as is the same as the embodiment of FIG. 3, and further a particulate retrapping portion 22 is arranged in the EGR gas route 4 at an upstream position of the filter 6. Therefore, it is possible to reduce the particulates in the EGR gas route 4 as compared with the embodiment shown in FIG. 1. In this case, it is preferred to arrange a particulate firing device in the particulate retrapping portion 22, since the particulates can be reduced more and more.

Figure 5:
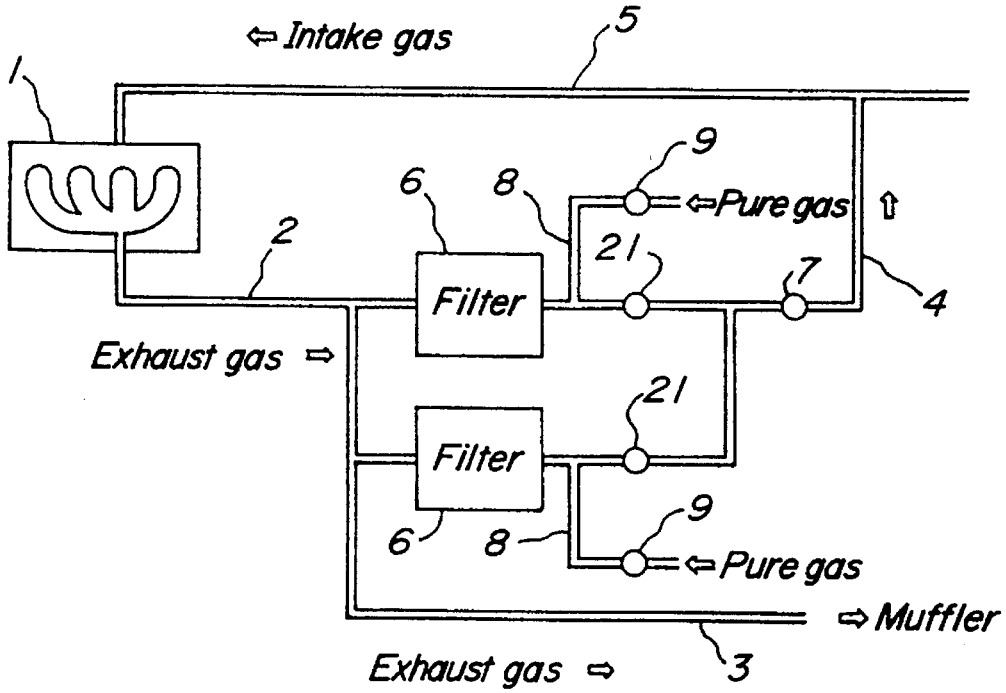
FIG. 5 is a schematic view illustrating still another embodiment of the EGR device according to the invention.
Figure 6:
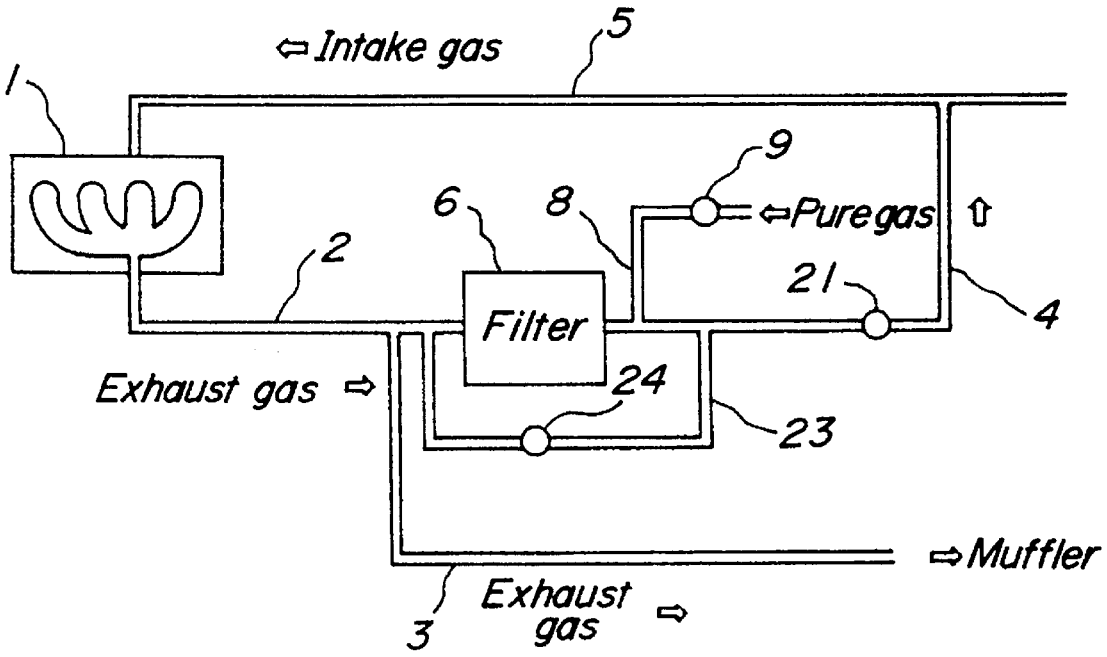
FIG. 6 is a schematic view depicting still another embodiment of the EGR device according to the invention.

In the embodiment shown in FIG. 5, two EGR gas routes 4 are arranged. Moreover, two filters 6 are arranged respectively in the EGR gas routes 4, and two exhaust valves 21 and two devices for generating the reverse air flow 11 are arranged respectively in the EGR gas route 4 at a downstream position of the filter 6. In this embodiment, it is possible to reduce an amount of particulates passing through one filter 6, and thus a life of the filter 6 can be made longer. In this case, the number of the filter 6, the device for generating the reverse air flow 11 or the exhaust valve 21 is not limited to two, but it is possible to make their number more than two.

In the embodiment mentioned above, when the reverse air flow is supplied to the filter 6, the exhaust valve 21 or the EGR valve 7 serving as the exhaust valve is closed so as to stop the exhaust gas flow and to make ease the reverse air flow in the filter 6. Therefore, there exists a problem such that the exhaust gas recirculation flow is temporarily stopped. In order to solve this problem, in the embodiment shown in FIG. 6, a bypass route 23 which connects an upstream position and a downstream position of the filter 6 is arranged and also an exhaust valve 24 is arranged in the bypass route 23 for regenerating the filter 6 without stopping the exhaust gas recirculation flow. Then, when the regeneration operation of the filter 6 is performed, the exhaust valve 24 is opened so as to pass the exhaust gas recirculation flow through the bypass route 23. Contrary to this, when the filter 6 is not regenerated, the exhaust valve 24 is closed so as not to pass the exhaust gas recirculation flow through the bypass route 23. In the embodiment shown in FIG. 5 in which plural filters 6 are arranged instead of arranging the bypass route 23, if the filter regeneration operation is performed alternately without stopping the exhaust gas recirculation flow, it is possible to perform the particulate trapping operation continuously.

In the embodiments mentioned above, when the reverse air flow is supplied to the filter 6, the reverse air control valve 9 is opened so as to flow the reverse air into the filter 6 after the EGR valve 7 is closed or the exhaust valve 21 is closed. The particulates discharged from the filter 6 are not returned to the engine 1 from a branch position among the EGR gas route 4 and the exhaust routes 2 and 3 due to an engine exhaust pressure and are discharged to the air through the exhaust gas route 3 and a muffler. In the embodiment shown in FIG. 4 in which the particulate re-trapping portion 22 is arranged at an upstream position of the filter 6, the particulates discharged from the filter 6 are not returned again to the filter 6 as compared with the other embodiments.

In order to control the EGR rate accurately, it is necessary to decrease a pressure loss of the filter 6 as much as possible. Therefore, it is preferred to use the filter 6 of a low pressure loss type. Moreover, as shown in FIG. 5, it is possible to achieve the low pressure loss of the filter 6 by using a plurality of filters 6. To achieve an accurate EGR rate control, it is preferred to use the filter 6 having a pressure loss less than 10 kPa more preferably 5 kPa.

As for the filter 6, use is made of a honeycomb structural filter having a plurality of cells defined by partition walls having a filtering performance, or a cross-flow filter having a plurality of stacked partitions having a filtering performance. That is to say, the cross-flow filter has a structure such that a plurality of plate-like filter elements each having a plurality of through-holes passing therethrough from one end surface to the other end surface are stacked via spacers so as to form a space therebetween. However, since the EGR device according to the invention is arranged near the engine, it is preferred to use the honeycomb structural filter having a large filtering area with taking into account of a small assembling space. As for a material of the filter 6, use is made of cordierite, alumina, mullite, silicon carbide, silicon nitride, zirconia, porous materials such as sintered metal or the like and three-dimensional net structural bodies formed by ceramics or metal fibers or the like. Preferably, use is made cordierite since it has an excellent heat resistivity and an excellent heat shock resistivity. Moreover, it is preferred to use the filter 6 having an average pore size of 5–100 μm preferably 10–80 μm.

It is preferred to make a particulate trapping efficiency of the filter 6 higher and higher. However, if the particulate trapping efficiency of the filter 6 is made higher, the average pore size of the filter 6 becomes small, and thus a pressure loss of the filter 6 becomes higher. Therefore, it is preferred to make the particulate trapping efficiency of the filter lower so as to perform an accurate EGR rate control, but if it becomes lower in excess, an amount of the particulates returned to the engine becomes larger. From this point of view, it is preferred to set the particulate trapping efficiency of the filter to 30–90% more preferably 50–80%. Actually, it is sufficient that only the particulates contributed to an abrasion of the engine parts are trapped by the filter 6. Therefore, fine particulates passing through the filter 6 cause no problem, and thus it is not necessary to set the particulate trapping efficiency not less than 90%. As for the particulates, there are carbon particles including an SOF component, abrasive metal pieces of engine parts or exhaust pipes, and inorganic substances included in an engine oil or the like. Among them, gathered carbon particles having a large diameter or the metal pieces causes a problem, and thus they must be trapped by the filter.

As for the reverse air flow, use is made of an air compressed by a compressor used in a track or a bus and so on. However, the compressed air is used for driving a valve for an exhaust brake and for driving a door and a cargo space, and thus it is not possible to use a large amount of the compressed air for the reverse air. Therefore, it is preferred to use the compressed air less than 20 liters per one reverse air flow under a room temperature and a normal pressure preferably less than 10 liters per one reverse air flow. Moreover, if an engine displacement is larger, an amount of the EGR gas increases accordingly, and thus a volume of the filter becomes larger. Under such a condition, in order to discharge the particulates in the filter out of the filter, it is necessary to use the reverse air flow having a volume substantially same preferably 2 times as that of the filter.

As clearly understood from the above, according to the invention, since the filter is arranged in the EGR gas route and the particulates trapped by the filter are discharged from the filter by using the reverse air flow generated from the device for generating the reverse air flow, it is possible to obtain the exhaust gas recirculation device for an internal combustion engine in which an abrupt pressure loss increase of the filter can be prevented. Moreover, in the case of the filter regeneration, the particles discharged from the filter are not returned to the engine due to the engine exhaust pressure and are discharged to the air through the muffler.

What is claimed is:

1. An exhaust gas recirculation device for an internal combustion engine comprising a filter for trapping particulates in a recirculation gas, which is arranged in a recirculation gas route, and a device for generating a reverse air flow in which a pure gas flow for said reverse air flow passing through said filter in a reverse direction with respect to a recirculation gas flowing direction in said filter is generated, wherein a filter regeneration is performed in such a manner that the trapped particulates are discharged out of said filter by said reverse air flow and the trapped particulates are not returned to said internal combustion engine.

2. The exhaust gas recirculation device according to claim 1, wherein an exhaust valve is arranged in a route of said recirculation gas flow at a downstream position of said filter.

3. The exhaust gas recirculation device according to claim 2, wherein said exhaust valve is served as a recirculation gas valve for adjusting an amount of the recirculation gas.

4. The exhaust gas recirculation device according to claim 2, wherein a bypass route having an exhaust valve is arranged between an upstream position and a downstream position of said filter, and the recirculation gas is flowed through said bypass route by opening said exhaust valve during a filter regeneration operation using said reverse air flow.

5. The exhaust gas recirculation device according to claim 2, wherein at least two filters are arranged parallelly in said recirculation gas route and said device for generating the reverse air flow is arranged respectively to said filters, so as to perform a filter regeneration operation alternately.

6. The exhaust gas recirculation device according to claim 1, wherein a particulate re-trapping portion is arranged in said recirculation gas route at an upstream position of said filter.

7. The exhaust gas recirculation device according to claim 6, wherein a particulate firing means is arranged in said particulate re-trapping portion.

8. The exhaust gas recirculation device according to claim 1, wherein said filter has a honeycomb structure having a plurality of cells defined by partition walls having a filtering performance, in which one end of one cell is sealed and the other end of said cell is opened while one end of the adjacent cell is opened and the other end of said adjacent cell is closed.

9. The exhaust gas recirculation device according to claim 1, wherein said filter has a structure such that a plurality of plate-like filter elements each having a plurality of through-holes passing therethrough from one end surface to the other end surface are stacked via spacers so as to form a space therebetween.

10. The exhaust gas recirculation device according to claim 1, wherein said filter is formed by porous ceramics, porous metals, ceramics filters or three-dimensional net structure metal fibers.

11. The exhaust gas recirculation device according to claim 1, wherein a pressure loss of said filter is less than 10 kPa under a condition such that a maximum recirculation gas is flowed.

12. The exhaust gas recirculation device according to claim 1, wherein a particulate trapping efficiency of said filter is in a range of 30%–90%.

13. The exhaust gas recirculation device according to claim 1, wherein an amount of said pure gas flow used as said reverse air flow is less than 20 liters per one reverse air flow under a room temperature and a normal pressure.

14. The exhaust gas recirculation device according to claim 1, wherein an amount of said pure gas flow used as said reverse air flow per one filter is less than a volume 2 times as large as that of said filter.

* * * * *